US009340938B2

(12) United States Patent
Ferrell et al.

(10) Patent No.: US 9,340,938 B2
(45) Date of Patent: May 17, 2016

(54) SNOW THROWER WITH CHUTE CONTROL MECHANISM

(75) Inventors: James C. Ferrell, Elberton, GA (US); William E. Colber, Jr., Lavonia, GA (US); Benjamin E. Montgomery, Anderson, SC (US)

(73) Assignee: TECHTRONIC OUTDOOR PRODUCTS TECHNOLOGY LIMITED, Hamilton (BM)

( * ) Notice: Subject to any disclaimer, the term of this patent is extended or adjusted under 35 U.S.C. 154(b) by 718 days.

(21) Appl. No.: 13/366,030

(22) Filed: Feb. 3, 2012

(65) Prior Publication Data

US 2012/0198732 A1 Aug. 9, 2012

Related U.S. Application Data

(60) Provisional application No. 61/440,167, filed on Feb. 7, 2011.

(51) Int. Cl.
*E01H 5/09* (2006.01)
*E01H 5/04* (2006.01)

(52) U.S. Cl.
CPC . *E01H 5/045* (2013.01); *E01H 5/09* (2013.01)

(58) Field of Classification Search
CPC ..... E01H 5/045; E01H 5/09; E01H 5/094; E01H 5/096; E01H 5/098; E01H 5/00; E01H 5/04; E01H 5/07; E01H 5/08; E01H 5/12
USPC ..... 37/260
See application file for complete search history.

(56) References Cited

U.S. PATENT DOCUMENTS

| | | | | | |
|---|---|---|---|---|---|
| 3,509,977 | A * | 5/1970 | Bacon | 193/22 | |
| 3,742,626 | A * | 7/1973 | Ellis | 37/260 | |
| 3,879,866 | A | 4/1975 | Gunderson | | |
| 3,921,315 | A | 11/1975 | Tome | | |
| 4,150,501 | A | 4/1979 | Hayashi | | |
| 4,205,468 | A * | 6/1980 | Greider | 37/260 | |
| 4,667,459 | A | 5/1987 | Scanland et al. | | |
| 4,862,607 | A | 9/1989 | Wacker | | |
| 4,951,403 | A | 8/1990 | Olmr | | |
| 5,221,229 | A * | 6/1993 | Brophy | A22C 25/02 452/101 | |
| 5,735,064 | A | 4/1998 | Holl | | |
| 5,758,436 | A | 6/1998 | Harms | | |
| 6,487,798 | B2 | 12/2002 | Sueshige | | |
| 6,499,238 | B2 | 12/2002 | Kluck et al. | | |
| 6,931,771 | B1 | 8/2005 | Liebl | | |
| 6,952,893 | B1 | 10/2005 | Sanderson | | |
| 7,032,333 | B2 | 4/2006 | Friberg et al. | | |

(Continued)

*Primary Examiner* — Thomas B Will
*Assistant Examiner* — Joan D Misa
(74) *Attorney, Agent, or Firm* — Michael Best & Friedrich LLP

(57) ABSTRACT

A snow thrower comprising a frame, a handle coupled to the frame, a chute coupled to the frame and rotatable between a plurality of positions about a chute axis, and a chute control assembly. The chute control assembly comprises an actuator assembly including an actuator movable between a plurality of positions, a rotatable flexible cable having first and second ends, and a gear assembly comprising at least one gear. The first end is coupled to the actuator assembly in a manner that causes the cable to rotate when the actuator is moved between the plurality of positions. The gear is coupled to the second end in a manner that causes the gear to rotate when the cable rotates. The chute is coupled to the gear in a manner that causes the chute to rotate about the chute axis when the gear rotates.

18 Claims, 14 Drawing Sheets

(56) References Cited

U.S. PATENT DOCUMENTS

| | | | | |
|---|---|---|---|---|
| 7,093,380 | B2 * | 8/2006 | Hubscher | E01H 5/098 172/679 |
| 7,194,827 | B2 | 3/2007 | Mercer et al. | |
| 7,347,013 | B2 | 3/2008 | Deschler et al. | |
| 7,472,500 | B2 | 1/2009 | White, III | |
| 7,591,086 | B2 | 9/2009 | Sueshige | |
| 7,624,521 | B2 | 12/2009 | White, III et al. | |
| 7,703,223 | B2 | 4/2010 | Walker et al. | |
| 7,735,246 | B2 | 6/2010 | Kaskawitz | |
| 2007/0084091 | A1 | 4/2007 | Umemura | |

* cited by examiner

SNOW THROWER WITH CHUTE CONTROL MECHANISM

RELATED APPLICATIONS

This application claims priority to U.S. Provisional Patent Application Ser. No. 61/440,167 filed on Feb. 7, 2011, the entire contents of which are hereby incorporated by reference.

FIELD

The present invention relates to snow throwers and, more particularly, to snow throwers having chute control mechanisms.

BACKGROUND

Snow throwers typically include a frame, wheels rotatably attached to the frame, a handle attached to the frame for pushing and directing the snow thrower, a chute coupled to the frame, an auger rotatably attached to the frame for directing snow to the chute, and an engine supported by the frame for driving the auger. The chute receives snow from the auger and directs (i.e., "throws") the snow in a predetermined direction relative to the frame. Some snow throwers include chutes that are moveable between various positions relative to the frame, where in each position the chute throws snow received from the auger in a different predetermined direction relative to the frame.

SUMMARY

In one aspect, this disclosure provides a snow thrower comprising a frame, a handle coupled to the frame, a chute coupled to the frame and rotatable between a plurality of positions about a chute axis, and a chute control assembly. The chute control assembly comprises an actuator assembly including an actuator movable between a plurality of positions, a rotatable flexible cable having first and second ends, and a gear assembly comprising at least one gear. The first end of the cable is coupled to the actuator assembly in a manner that causes the cable to rotate when the actuator is moved between the plurality of positions. The gear is coupled to the second end of the cable in a manner that causes the gear to rotate when the cable rotates. The chute is coupled to the gear in a manner that causes the chute to rotate about the chute axis when the gear rotates.

In another aspect, this disclosure provides a snow thrower comprising a frame, a handle coupled to the frame, a chute coupled to the frame and rotatable about a chute axis, and a chute control assembly. The chute control assembly comprises a shaft rotatable about a shaft axis and having a non-linear groove, an actuator slidably mounted on the shaft and including a projection that extends into the groove, the projection translating through the groove when the actuator slides along the shaft, thereby rotating the shaft about the shaft axis, and a coupling assembly adapted to cause the chute to rotate about the chute axis upon rotation of the shaft about the shaft axis.

In yet another aspect, this disclosure provides a snow thrower comprising a frame, a handle coupled to the frame, an actuator movable between a plurality of positions, and a chute coupled to the frame and rotatable about a chute axis. The chute is coupled to the actuator by a coupling assembly comprising a rotatable flexible cable. Moving the actuator between the plurality of positions causes the cable to rotate thereby causing the chute to rotate about the chute axis.

Other independent aspects of the invention will become apparent by consideration of the detailed description, claims, and accompanying drawings.

DETAILED DESCRIPTION

Figure 1:
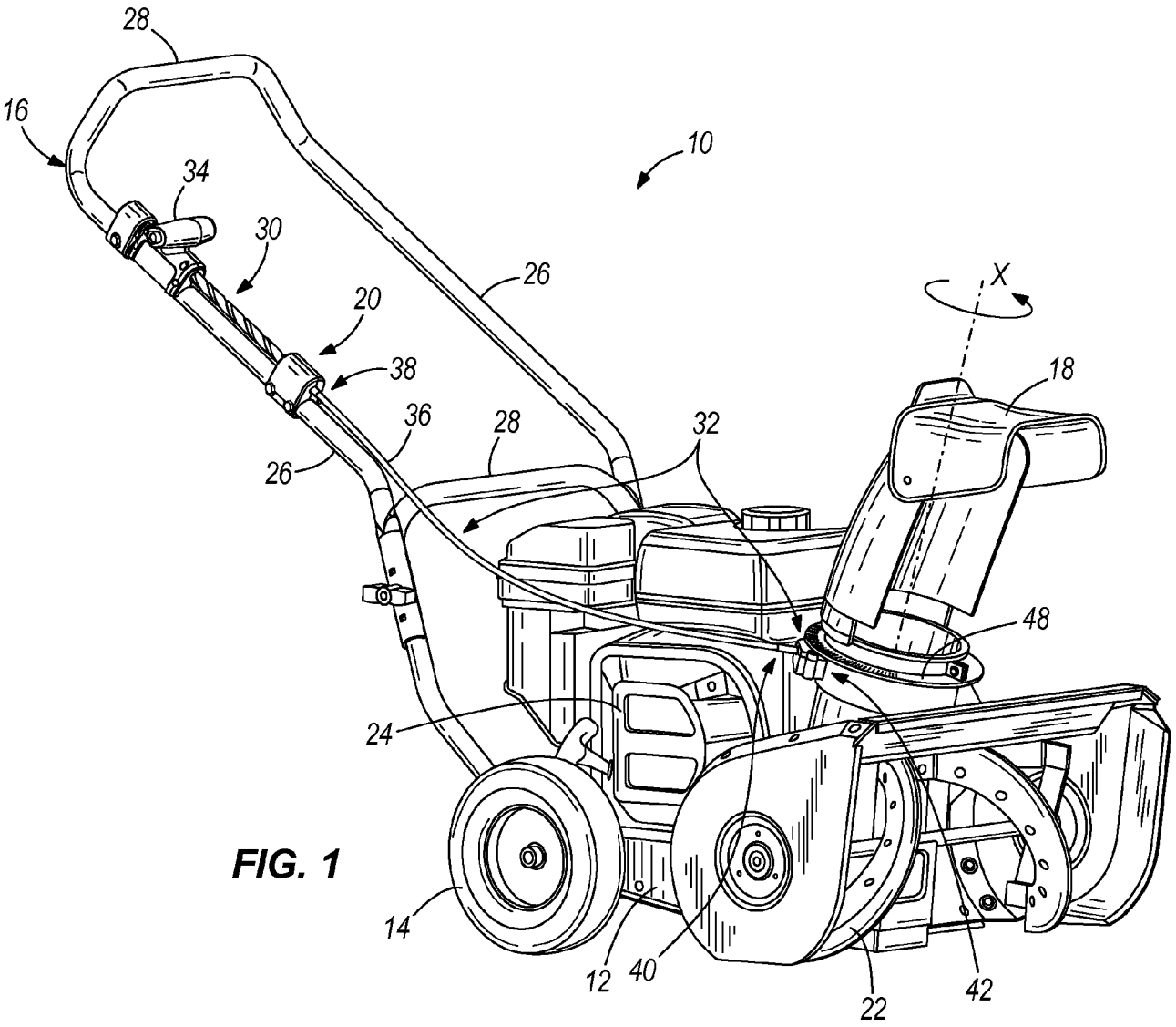
FIG. 1 is a perspective view of an exemplary snow thrower.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Ordinal indicators, such as first, second, and third, as used in the description and the claims to refer to various structures, are not meant to be construed to indicate any specific structures, or any particular order or configuration to such structures. All methods described herein can be performed in any suitable order unless otherwise indicated herein or otherwise clearly contradicted by context. The use of any and all examples, or exemplary language (e.g., "such as") provided herein, is intended merely to better illuminate aspects of the invention and does not pose a limitation on the scope of the invention unless otherwise claimed. No language in the specification, and no structures shown in the drawings, should be construed as indicating that any non-claimed element is essential to the practice of the invention.

FIG. 1 generally illustrates an exemplary snow thrower 10 according to aspects of the present disclosure. The snow thrower includes a frame 12, wheels 14 rotatably attached to the frame for rolling the snow thrower along the ground, a handle 16 attached to the frame for pushing and directing the snow thrower, a chute 18 coupled to the frame and rotatable between a plurality of positions relative to the frame about a chute axis X, a chute control assembly 20 for selectively controlling the position of the chute relative to the frame, an auger 22 rotatably connected to the frame for directing snow to the chute, and an engine 24 supported by the frame for driving the auger. The chute is configured to throw snow received from the auger away from the frame. Specifically, for each position of the chute relative to the frame, the chute is configured to throw snow received from the auger in a discrete direction relative to the frame.

The handle 16 may include one or more parts consistent with its function of providing a means for pushing and directing the snow thrower. For example, the handle may include one or more rearwardly and upwardly extending members 26 and one or more transversely or horizontally extending members 28 that function together to provide an upright user with a means for controlling the position of the snow thrower. The rearwardly and transversely extending members 26 and 28 may be integral with one another or may be formed of multiple components that enable a user to collapse or expand the handle between stowed or operational configurations, respectively. The handle also may include one or more fasteners for securing the handle to the frame, according to known or hereinafter devised methods. Finally, the handle may provide a purchase for securing one or more components of the chute control assembly, as is illustrated in FIG. 1 and described below.

The chute control assembly 20 may include an actuator assembly 30 and a coupling assembly 32 that collectively enable a user to selectively control the position of the chute 18 relative to the frame 12. The actuator assembly includes an actuator 34 selectively moveable between a plurality positions. As is described in more detail below with reference to the various specific embodiments, the actuator assembly also may include other components for mechanically converting the motion of the actuator into forces that subsequently are used to rotate the chute about the chute axis.

The coupling assembly 32 includes various components for coupling the actuator assembly 30 to the chute 18, such that moving the actuator 34 between the plurality of positions causes the chute to rotate about the chute axis X. For example, some coupling assemblies may include a rotatable flexible cable 36 having a first end 38 coupled to the actuator assembly and a second end 40 coupled to the chute. The first end may be coupled to the actuator assembly in a manner that causes the cable to rotate when the actuator is moved between the plurality of actuator positions. The second end, in turn, may be coupled to the chute in a manner that causes the chute to rotate about the chute axis when the cable rotates. The first and second ends of the rotatable flexible cable may be coupled to the actuator assembly and the chute according to any known or hereinafter devised method, and may include the use of various other components, assemblies, fasteners, and the like. For example, some coupling assemblies may include a gear assembly 42 having at least one gear, where the gear assembly is coupled to the second end of the cable in a manner that causes the gear to rotate when the cable rotates, and where the chute is coupled to the gear assembly in a manner that causes the chute to rotate about the chute axis when the gear rotates. More specific means for coupling the first and second ends of the cable to the actuator and chute, respectively, will become apparent with reference to the various embodiments discussed below. Also as will become apparent, using a flexible rotatable cable to couple the actuator to the chute enables for positioning the actuator in any convenient location on the snow thrower 10, thus providing a significant improvement over known chute control assemblies.

Figure 2:
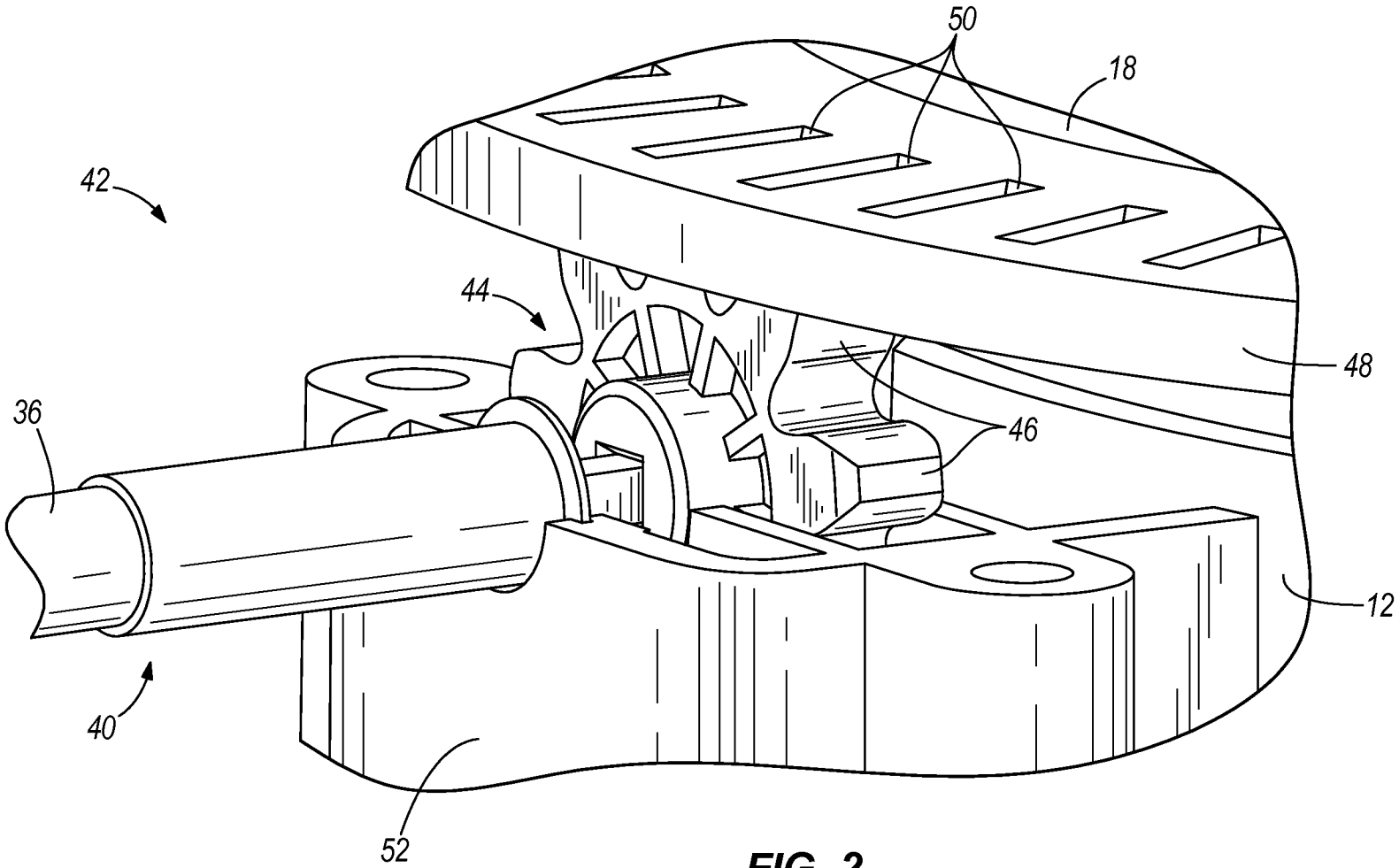
FIG. 2 is a perspective view of an exemplary gear assembly.

FIG. 2 shows an exemplary gear assembly 42 for coupling the second end 40 of a rotatable flexible cable 36 to the chute 18. As indicated above, the gear assembly generally may include at least one gear coupled to the second end of the cable and to the chute, such that rotating the cable (e.g., by moving the actuator) causes the gear to rotate, thereby causing the chute to rotate about chute axis X. For example, the gear may be a spoked gear 44 that has a plurality of spokes 46 and is fastened to the second end of the cable (e.g., by any suitable fastening means currently known or hereinafter devised), and the gear assembly further may include a slotted member 48 that has a plurality of slots 50, is attached to the chute and circumferentially surrounds the chute axis X. The spoked gear and slotted member may be positioned relative to one another such that the spokes progressively engage the slots when the spoked gear is rotated, thereby rotating the slotted member and the chute about the chute axis. For example, the spoked gear may be positioned within a gear housing 52 mounted on the frame 12 proximate the chute and the slotted member, such that both the second end of the cable and the spoked gear freely rotate relative to the housing, but so that the housing prevents or inhibits the spoked gear from moving translationally relative to the housing and the frame.

Figure 3:
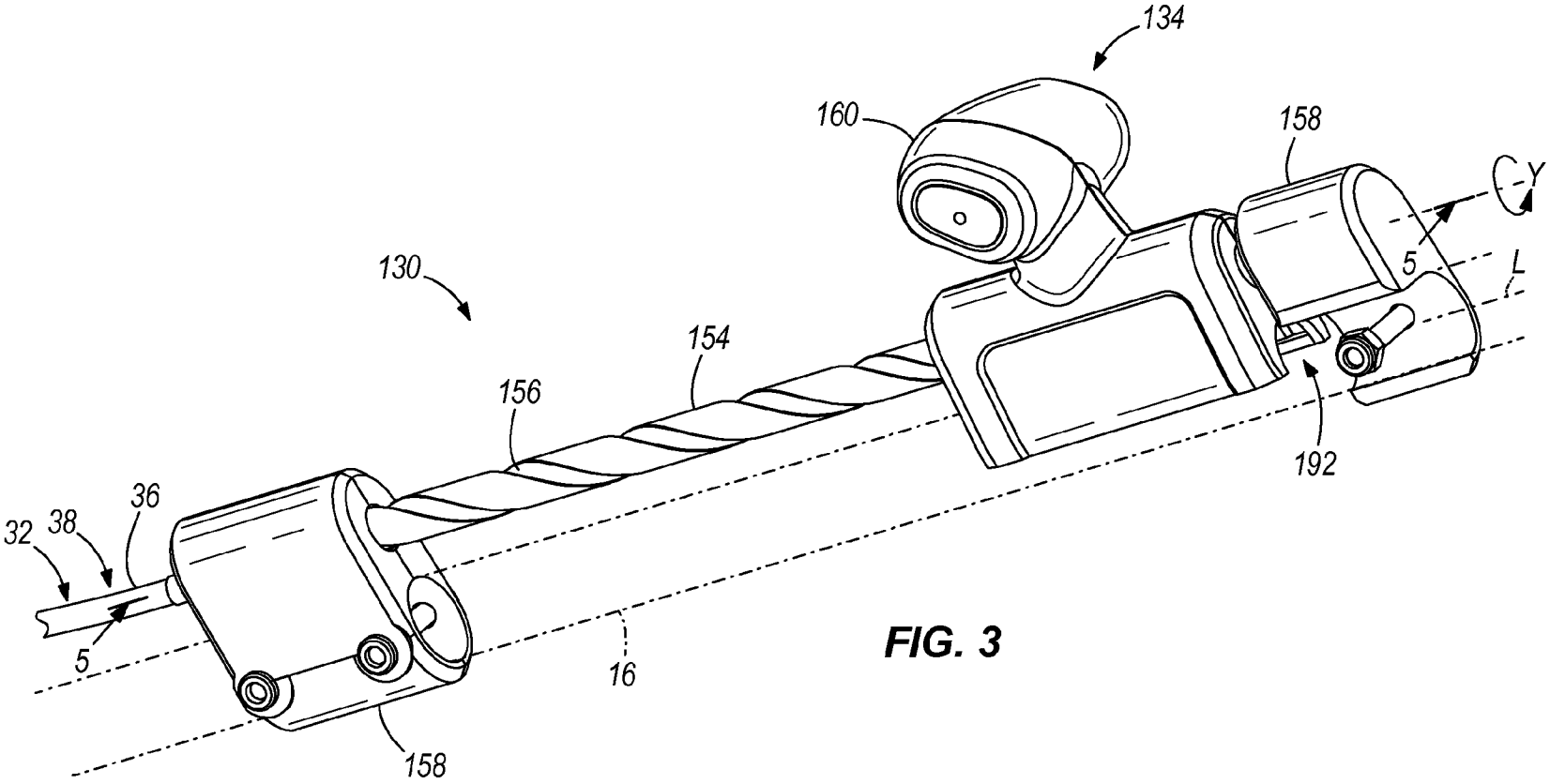
FIG. 3 is a perspective view of an exemplary actuator assembly.
Figure 4:
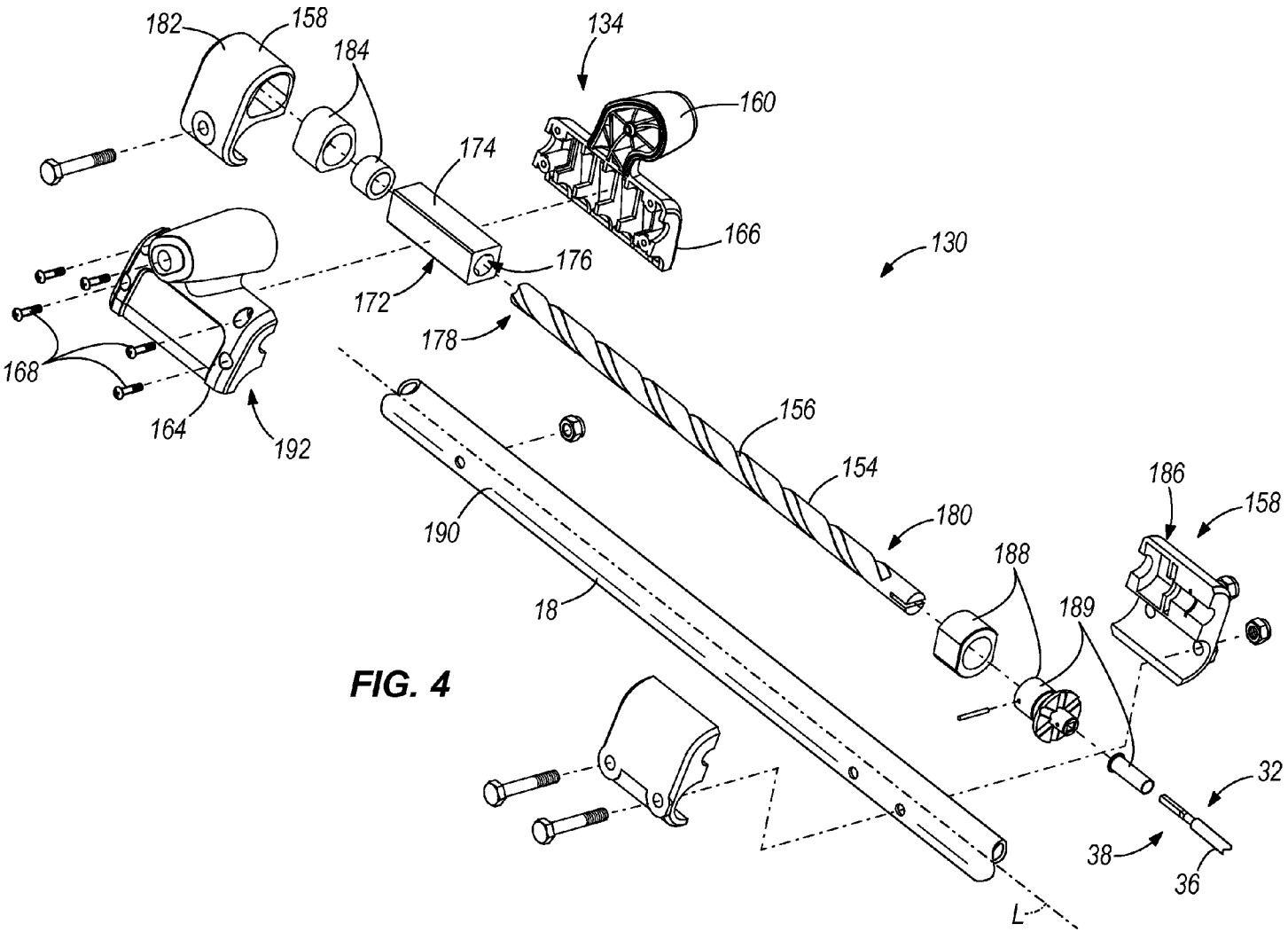
FIG. 4 is an exploded view of the exemplary actuator assembly of FIG. 3.
Figure 5:
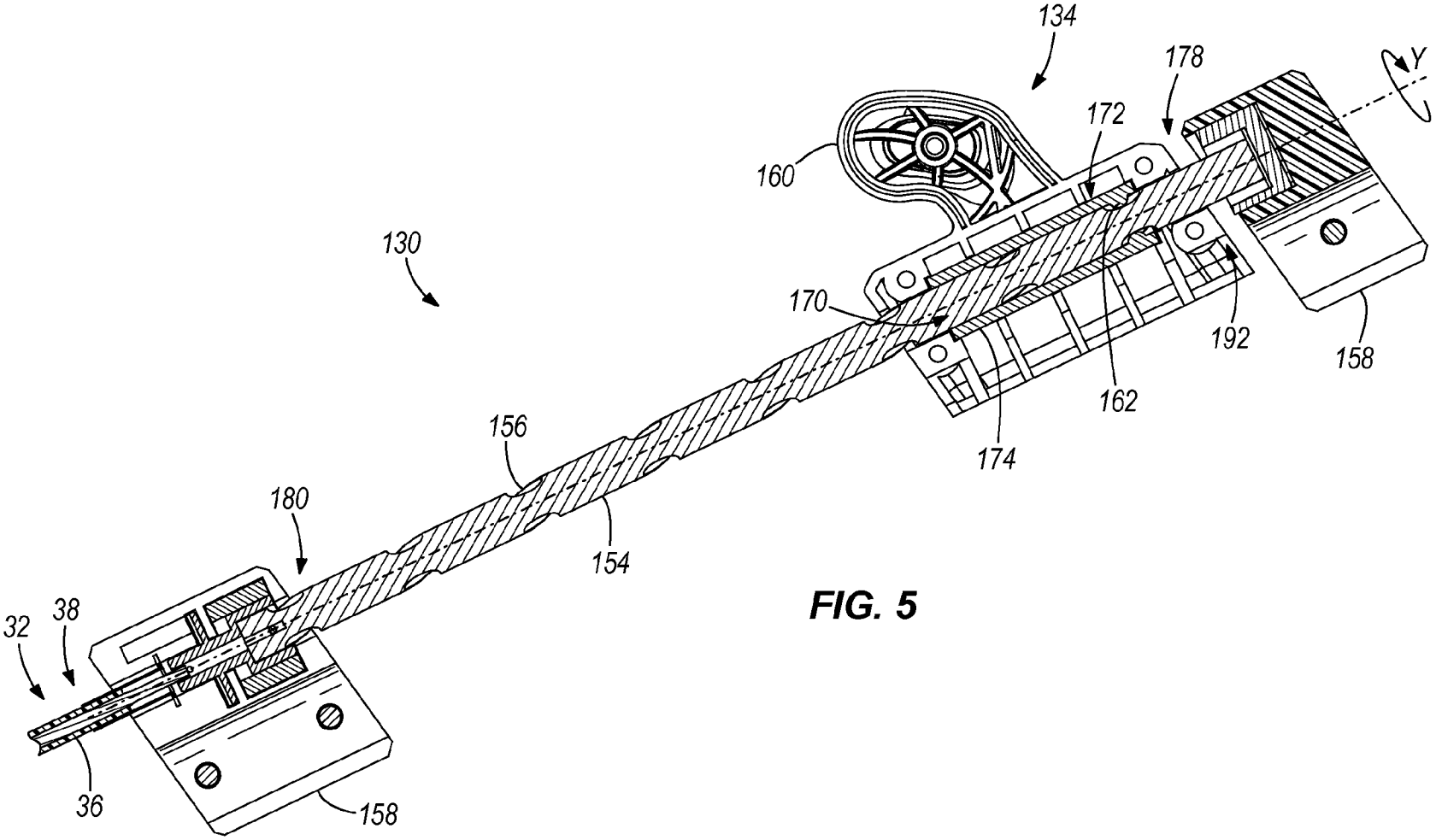
FIG. 5 is a cross-sectional side view of the exemplary actuator assembly of FIGS. 3 and 4 taken generally along cross-section 5-5 shown in FIG. 3.

FIGS. 3-5 show an exemplary actuator assembly 130 coupled to a coupling assembly 32, such as to the first end 38 of a rotatable flexible cable 36. The actuator assembly may include one or more of an actuator 134, a shaft 154 rotatable about a shaft axis Y and having a non-linear groove 156, and mounting members 158 for mounting the actuator assembly to a desired portion of the snow thrower. The actuator may include a handgrip 160 that enables a user to easily grasp and move the actuator. The actuator may be slidably mounted on the shaft and may include a projection 162 (see FIG. 5) that extends into the non-linear groove of the shaft. When the actuator slides along the shaft, the projection may translate through the groove, thereby causing the shaft to rotate about the shaft axis. For example, the actuator may include a pair of housing members 164, 166 (see FIG. 4) fastened together by one or more fasteners 168 and defining an aperture 170 having an internal shape and size (e.g., diameter) corresponding to the outer shape and size of the shaft along its length, such that the aperture freely slides along the length of the shaft. In some embodiments, the projection 160 may extend into the aperture defined by the housing members. Some actuators further may include an internal component 172, such as a substantially rectangular element 174, positioned between the housing members and defining an aperture 176 having an internal shape and size corresponding the outer shape and size of the shaft (see FIG. 4), where the projection extends into the aperture defined in the internal component.

As indicated above, the shaft 154 may be rotatable about a shaft axis Y and may include a non-linear groove 156. In some embodiments, the groove may form a spiral, such as a helix, that winds about the shaft axis Y. The shaft may include a first end 178 and a second end 180, and may be mounted to the snow thrower 10 by mounting members 158. For example, a first mounting bracket 182 may be configured to receive and rotatably support the first end of the shaft (e.g., via bushings 184 supported within mounting bracket 182), and a second mounting bracket 186 may be configured to receive and rotatably support the second end of the shaft (e.g., via bushings 188 supported within mounting bracket 186). The second end of the shaft may be coupled to the first end 38 of the rotatable flexible cable 36 in a manner that causes the cable to rotate when the shaft rotates. For example, the cable and shaft may be directly fastened to one another, such as by any suitable fasteners (e.g., fasteners 189) currently known or hereinafter devised.

The mounting members 158 may be configured to mount the actuator assembly 130 to any desired portion of the snow thrower 10. For example, the mounting brackets 182 and 186 may be configured to mount the actuator assembly to a portion of the handle 16, where the actuator 134 is readily accessible to an operator of the snow thrower. Specifically, the mounting brackets 182 and 186 may be secured to the handle using fasteners or may function as clamps having multiple components that clamp onto the handle. It should be appreciated that alternative mounting members may be used, according to known methods, to rotatably mount a shaft to any desired portion of the snow thrower.

In some embodiments, the actuator assembly may be configured so that the actuator does not rotate about the shaft axis Y when the actuator slides along the shaft. For example, the actuator assembly 130 may include an actuator guide member 190 that prevents or inhibits the actuator 134 from rotating about the shaft axis Y when the actuator slides along the shaft 154. More specifically, the actuator guide member may include an elongate member having a longitudinal axis L substantially parallel to the shaft axis Y (see FIG. 3), where the actuator slidably engages the elongate member as it slides along the shaft. In some embodiments, the actuator may include an aperture, notch, groove, detent or other similar feature, such as groove 192 (see FIG. 3), which slidably engages the actuator guide member as the actuator slides along the shaft. In some embodiments, the actuator guide member may include a portion of the handle 16.

Figure 6:
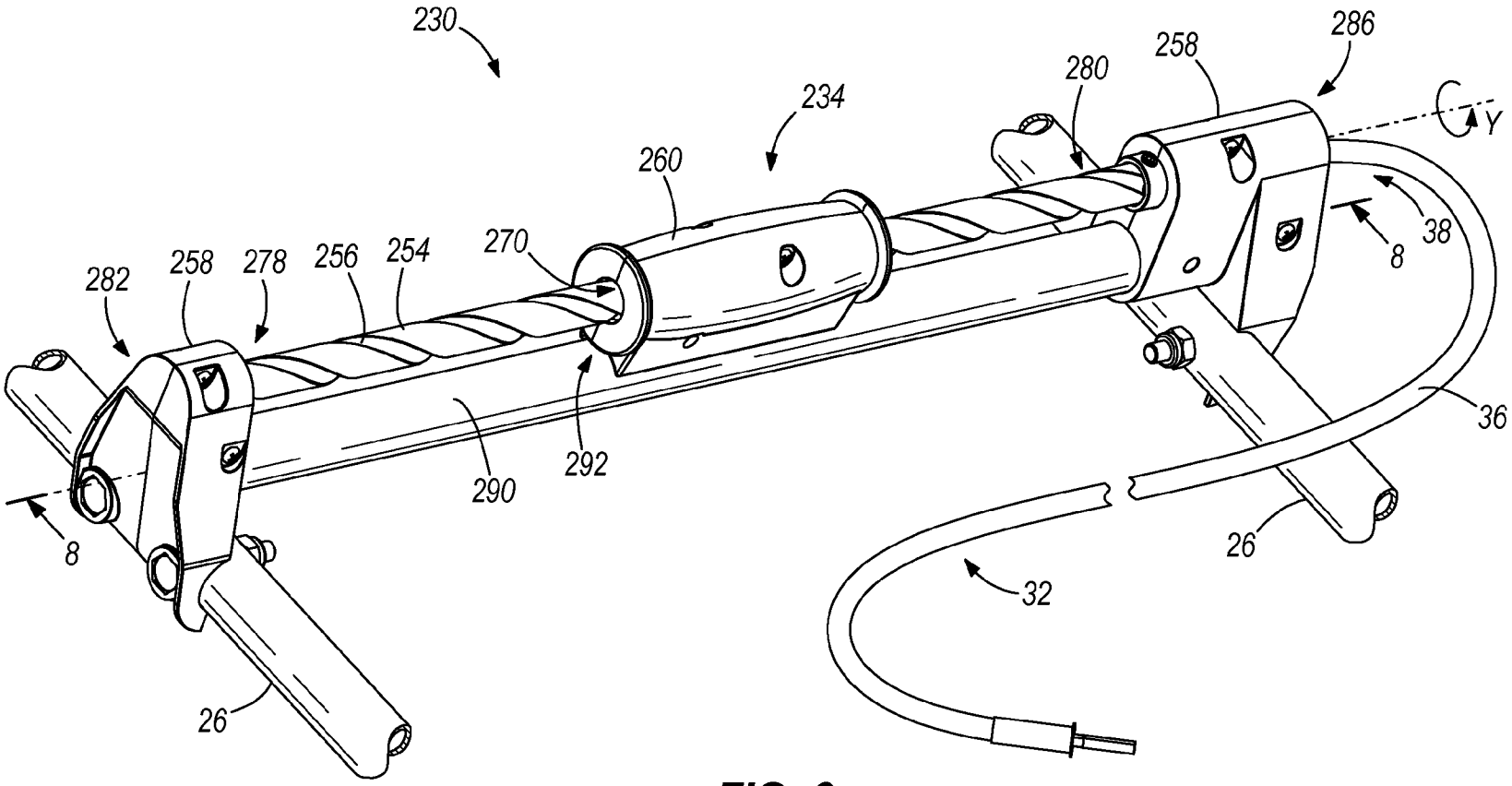
FIG. 6 is a perspective view of another exemplary actuator assembly.
Figure 7:
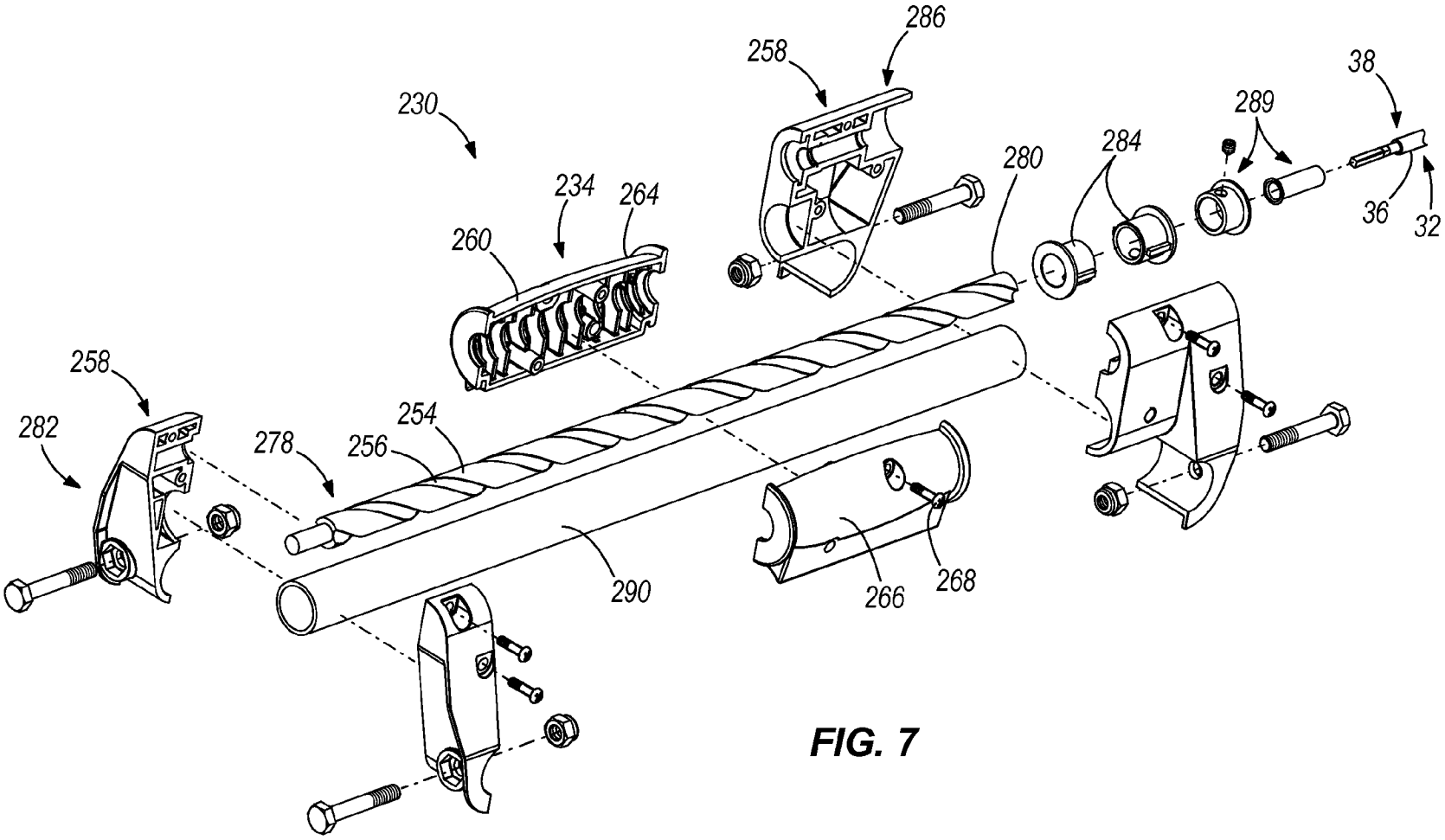
FIG. 7 is an exploded view of the exemplary actuator assembly of FIG. 6.
Figure 8:
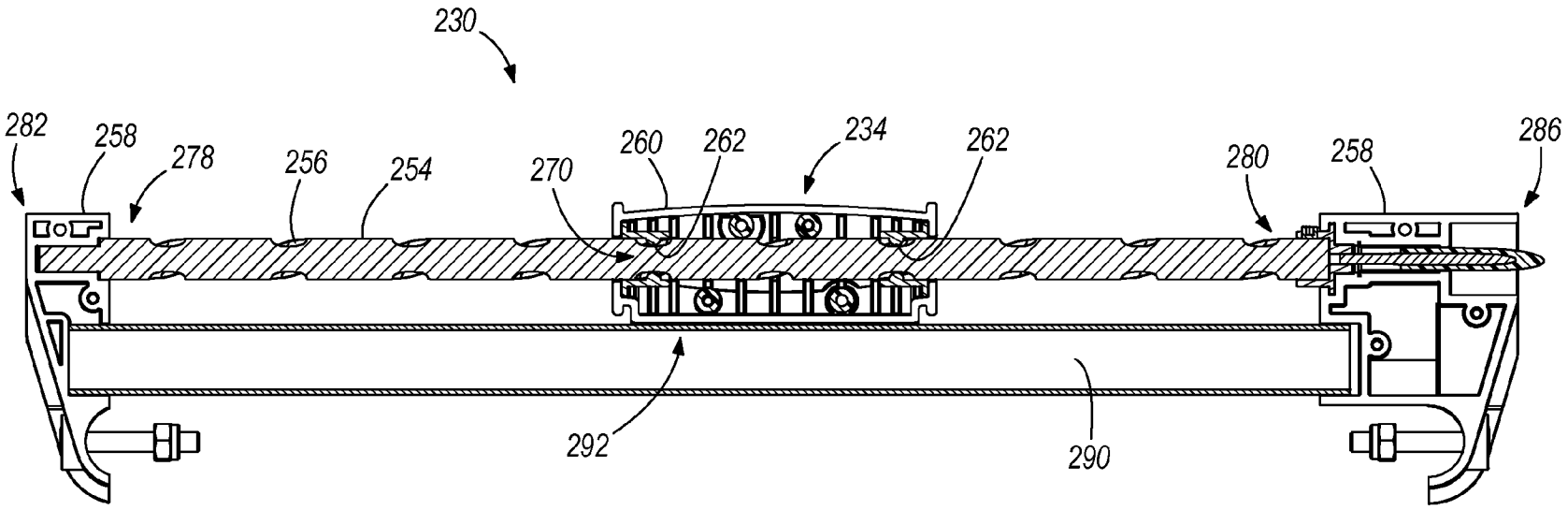
FIG. 8 is a cross-sectional side view of the exemplary actuator assembly of FIGS. 6 and 7 taken generally along cross-section 8-8 shown in FIG. 6.

FIGS. 6-8 show another exemplary embodiment of an actuator assembly 230 for a snow thrower coupled to a coupling assembly 32, such as to the first end 38 of a rotatable flexible cable 36. Similar to the actuator assembly 130 of FIGS. 3-5, the actuator assembly 230 of FIGS. 6-8 may include one or more of an actuator 234, a shaft 254 rotatable about a shaft axis Y and having a non-linear groove 256, and mounting members 258 for mounting the actuator assembly to a selected portion of the snow thrower. As illustrated in the drawings, the actuator assembly 230 may include many substantially similar structures to those described with respect to the actuator assembly 130, including, but not limited to, a handgrip 260, a projection 262 for engaging the non-linear groove (see FIG. 8), housing portions 264 and 266, fasteners 268, an aperture 270, first and second shaft ends 278 and 280, mounting brackets 282 and 286, bushings 284, fasteners 289, and/or an actuator guide member 290. In contrast to actuator assembly 130, actuator assembly 230 may be configured to mount to the handle 16 with the shaft 254 positioned substantially horizontally relative to the ground when the snow thrower is positioned in a substantially upright position. Specifically, the mounting members 258 may be configured to mount to opposing rearwardly extending handle members 26, thereby causing the actuator assembly 230 to span the space between the handle members. Alternatively, the actuator assembly 230 may be configured to mount to a transversely or horizontally extending handle member 28 (not shown). It should be noted that the actuator guide member 290—which may be engaged by a notch 292 or other similar structure on the actuator 234 to prevent or inhibit the actuator from rotating about the shaft axis Y when the actuator is slid along the shaft 254—may be a portion of the handle, or may be a separate member mounted between the mounting brackets 258, as is shown in FIGS. 6-8.

Figure 9:
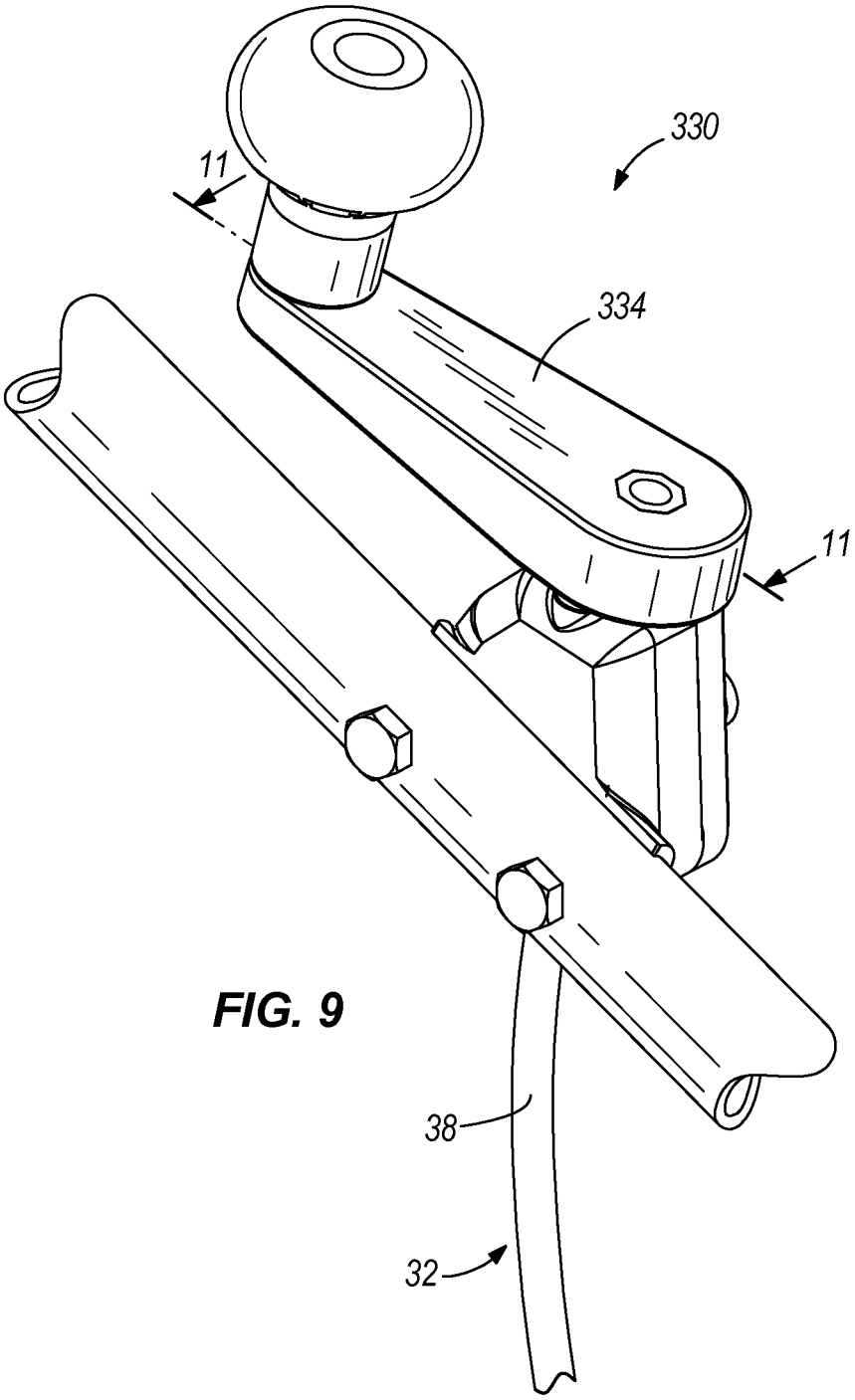
FIG. 9 is a perspective view of yet another exemplary actuator assembly.
Figure 10:
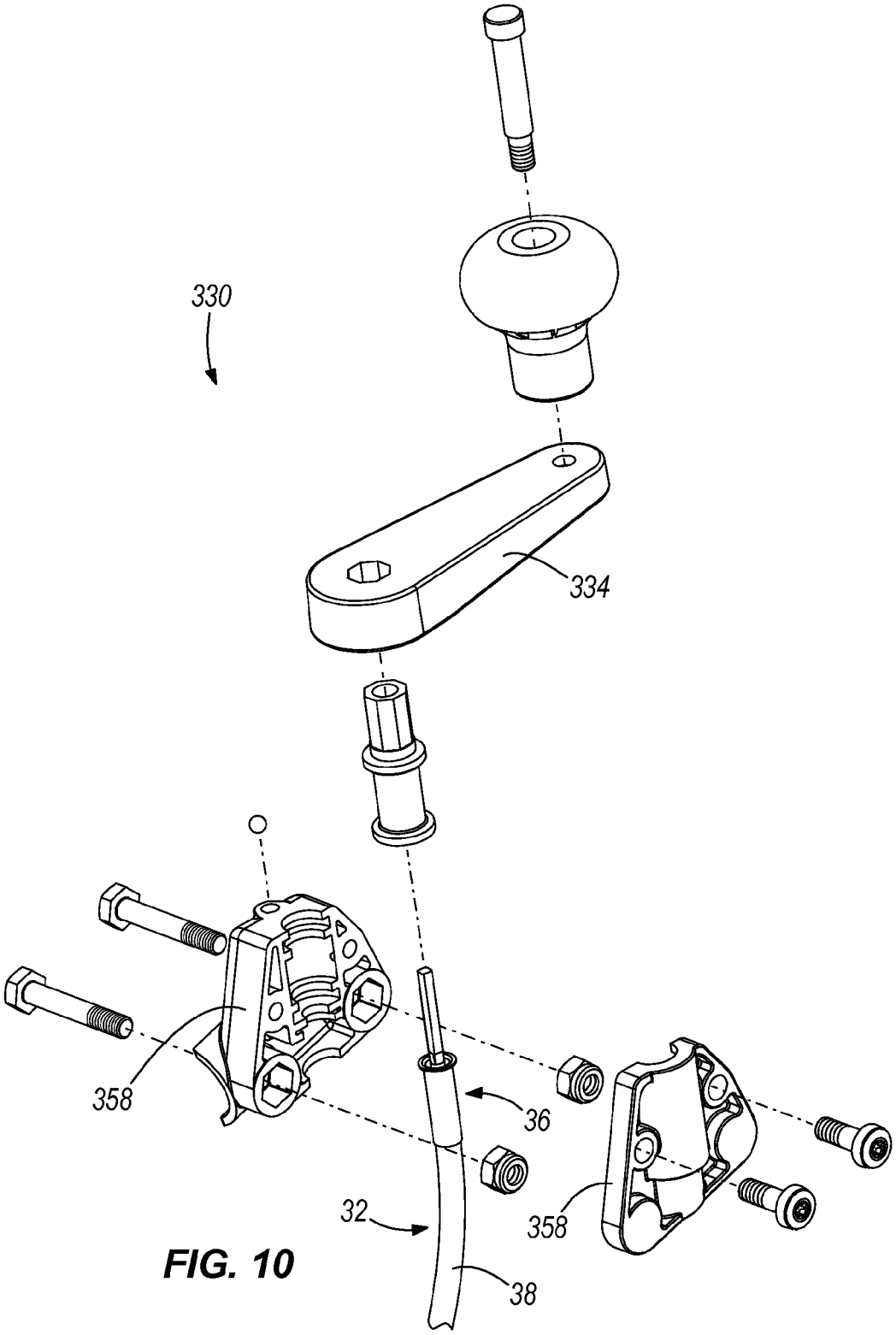
FIG. 10 is an exploded view of the exemplary actuator assembly of FIG. 9.
Figure 11:
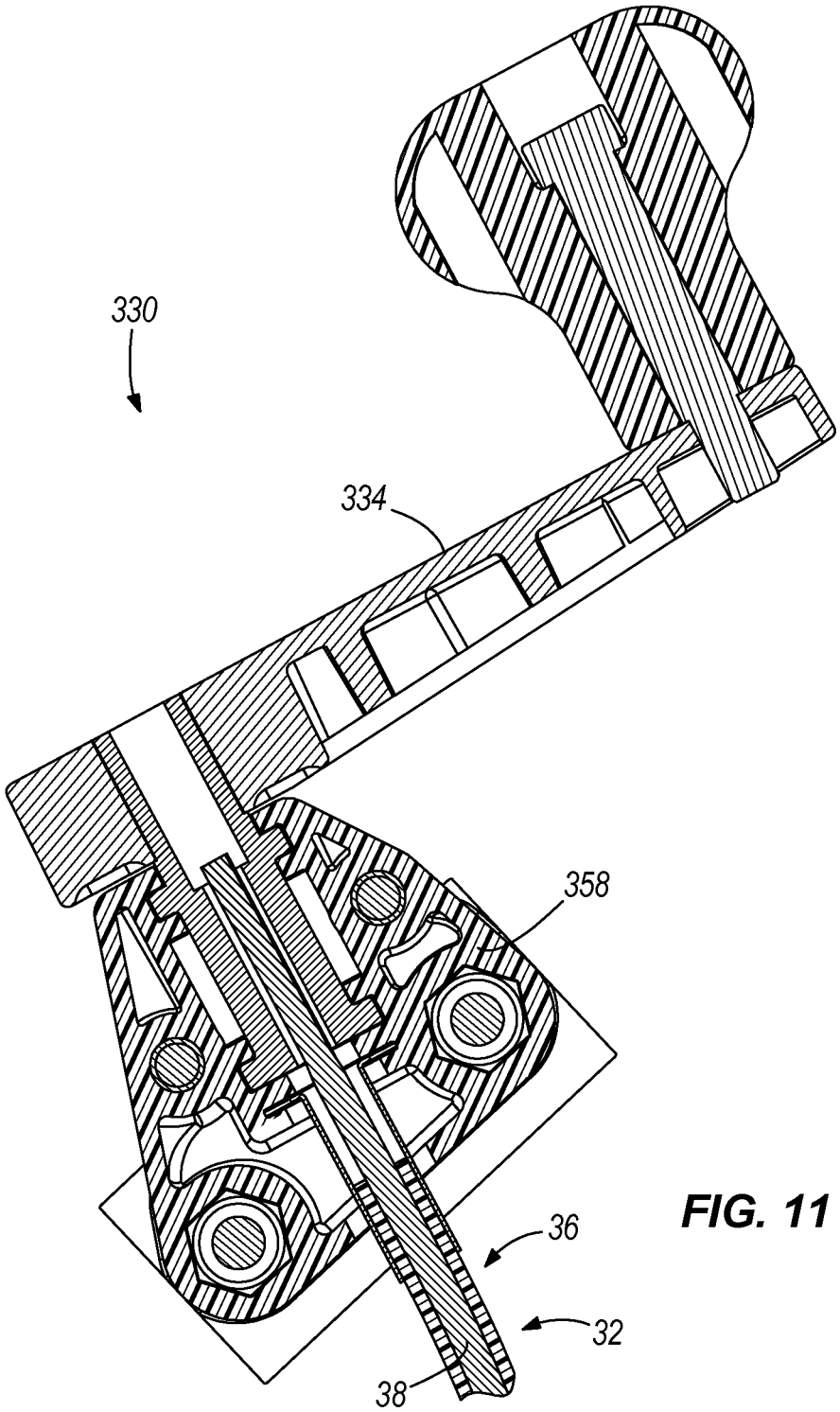
FIG. 11 is a cross-sectional view of the exemplary actuator assembly of FIGS. 9 and 10 taken generally along cross-section 11-11 shown in FIG. 9

FIGS. 9-11 show yet another exemplary embodiment of an actuator assembly 330 for a snow thrower coupled to a coupling assembly 32, such as to the first end 38 of a rotatable flexible cable 36. Similar to the actuator assemblies 130 and 230 discussed above, the actuator assembly 330 may include an actuator 334, and one or more mounting members 358 for mounting the actuator assembly to a selected portion of the snow thrower. However, rather than having an actuator that is slidably mounted to a rotatable shaft, the actuator 334 may include a crank rotatably mounted to the mounting member, where the first end of the cable is coupled to the crank in a manner that causes the cable to rotate when the crank is rotated.

Figure 12:
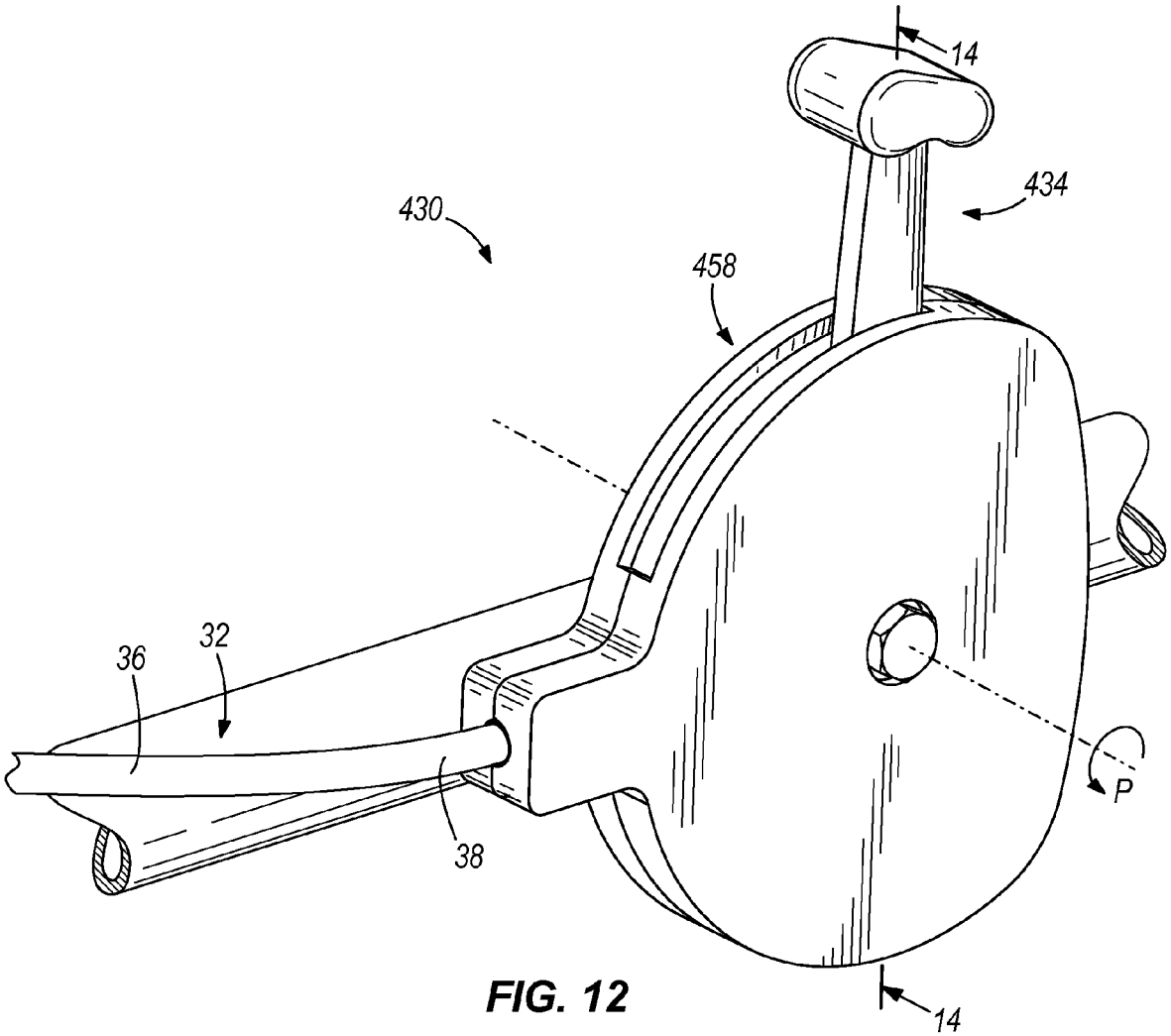
FIG. 12 is a perspective view of yet another exemplary actuator assembly.
Figure 13:
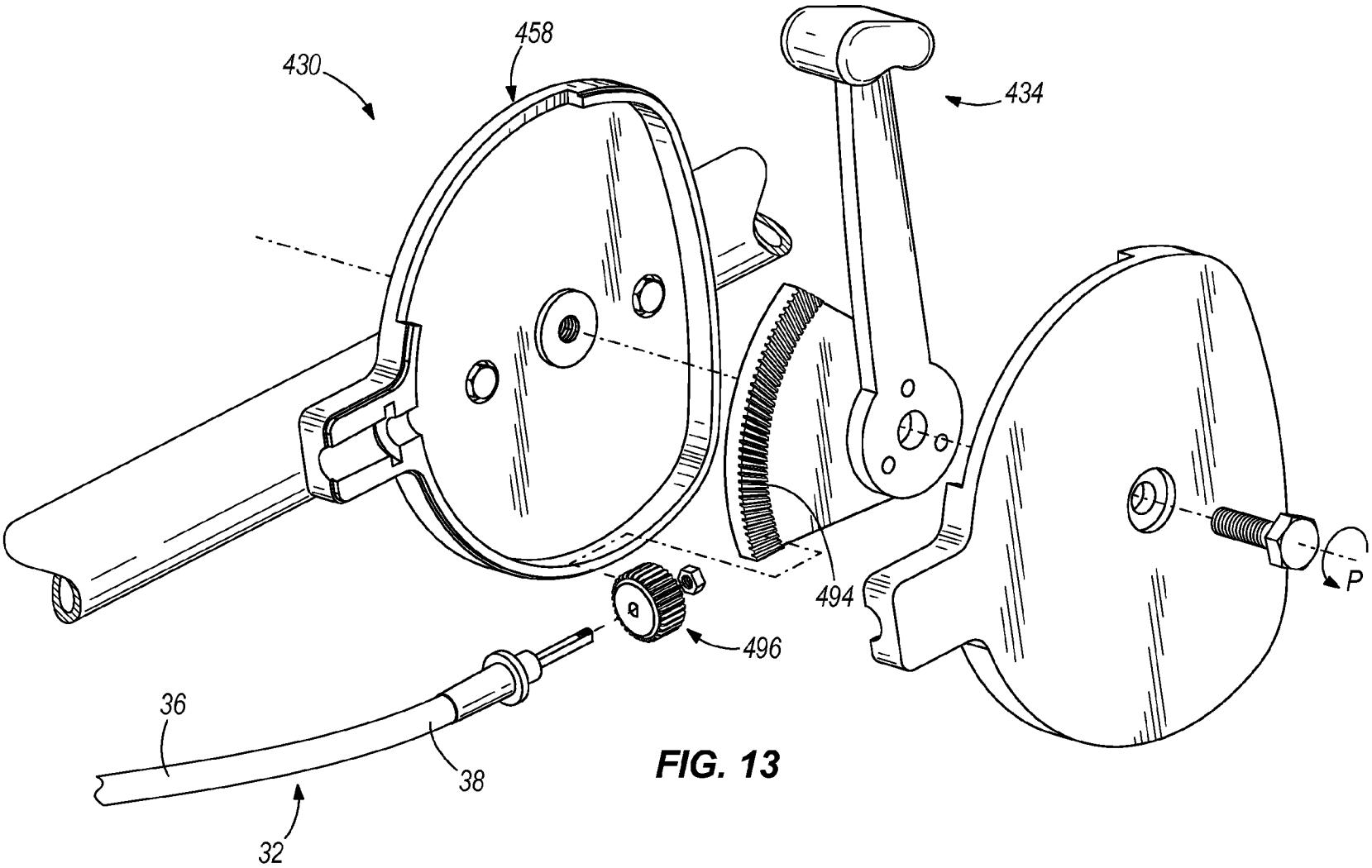
FIG. 13 is an exploded view of the exemplary actuator assembly of FIG. 12.
Figure 14:
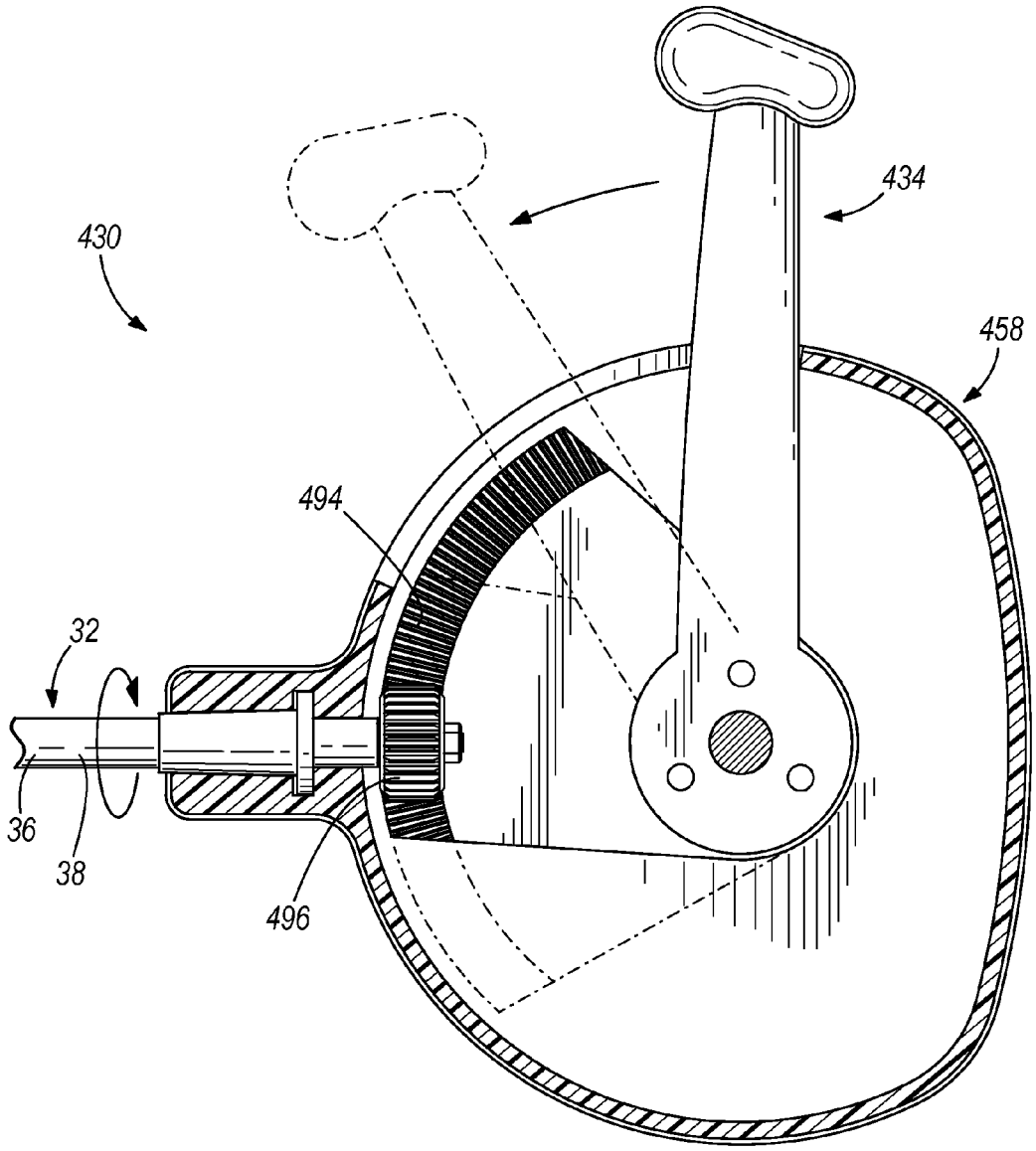
FIG. 14 is a partial cross-sectional side view of the exemplary actuator assembly of FIGS. 12 and 13 taken generally along cross-section 14-14 shown in FIG. 12.

FIGS. 12-14 show yet another exemplary embodiment of an actuator assembly 430 for a snow thrower coupled to a coupling assembly 32, such as to the first end 38 of a rotatable flexible cable 36. Similar to the actuator assemblies 130, 230 and 330 discussed above, the actuator assembly 430 may include an actuator 434, and one or more mounting members 458 for mounting the actuator assembly to a selected portion of the snow thrower. The actuator 434 may be configured to pivot between a plurality of positions about a pivot axis P, and may include a rack 494. The actuator assembly further may include a pinion gear 496 coupled to the first end of the cable. The rack and pinion gear may be positioned adjacent to one another, such that pivoting the actuator between the plurality of positions causes the rack to rotate the pinion gear, thereby rotating the cable.

Other independent aspects of the invention will become apparent upon consideration of the following claims.

What is claimed is:

1. A snow thrower comprising:
- a frame;
- a handle coupled to the frame;
- a chute coupled to the frame and rotatable about a chute axis; and
- a chute control assembly, comprising:
  - an actuator assembly including an actuator linearly movable between a plurality of positions;
  - a rotatable flexible cable having first and second ends and defining a cable axis; and
  - a gear assembly comprising at least one gear;
  - wherein the first end is coupled to the actuator assembly in a manner that causes the cable to rotate about the cable axis when the actuator is linearly moved between the plurality of positions;
  - wherein the gear assembly is coupled to the second end in a manner that causes the gear to rotate when the cable rotates; and
  - wherein the chute is coupled to the gear assembly in a manner that causes the chute to rotate about the chute axis when the gear rotates.

2. The snow thrower of claim 1, wherein the actuator assembly is mounted on the handle.

3. The snow thrower of claim 1, wherein the gear is a spoked gear fastened to the second end of the cable, and the gear assembly further includes a slotted member attached to the chute and circumferentially surrounding the chute axis, wherein rotating the spoked gear causes spokes of the spoked gear to engage slots of the slotted member, thereby rotating the slotted member and the chute about the chute axis.

4. The snow thrower of claim 1, wherein:
- the actuator assembly further includes a shaft rotatable about a shaft axis and having a non-linear groove;
- the actuator is slidably mounted on the shaft and includes a projection that extends into the groove;

the projection translates through the groove when the actuator slides along the shaft, thereby rotating the shaft about the shaft axis; and the first end is coupled to the shaft in a manner that causes the cable to rotate when the shaft rotates.

5. The snow thrower of claim 4, wherein the groove is helical.

6. The snow thrower of claim 4, wherein the actuator does not rotate about the shaft axis when the actuator slides along the shaft.

7. The snow thrower of claim 4, wherein the actuator assembly further includes an actuator guide member that prevents or inhibits the actuator from rotating about the shaft axis when the actuator slides along the shaft.

8. The snow thrower of claim 7, wherein the actuator guide member is an elongate member having a longitudinal axis substantially parallel to the shaft axis, and the actuator slidably engages the elongate member.

9. The snow thrower of claim 7, wherein the actuator guide member comprises a portion of the handle.

10. The snow thrower of claim 7, wherein the actuator guide member is substantially horizontal when the snow thrower is positioned in a substantially upright position.

11. A snow thrower comprising:

a frame;

a handle coupled to the frame;

a chute coupled to the frame and rotatable about a chute axis; and a chute control assembly, comprising:

a shaft rotatable about a shaft axis and having a non-linear groove;

an actuator slidably mounted on the shaft and including a projection that extends into the groove, the projection translating through the groove when the actuator slides along the shaft, thereby rotating the shaft about the shaft axis; and a coupling assembly adapted to cause the chute to rotate about the chute axis upon rotation of the shaft about the shaft axis.

12. The snow thrower of claim 11, wherein the groove is a helical.

13. The snow thrower of claim 11, wherein the actuator does not rotate about the shaft axis when the actuator slides along the shaft.

14. The snow thrower of claim 11, wherein the chute control assembly further includes an actuator guide member that prevents or inhibits the actuator from rotating about the shaft axis when the actuator slides along the shaft.

15. The snow thrower of claim 14, wherein the actuator guide member is an elongate member having a longitudinal axis substantially parallel to the shaft axis, and the actuator slidably engages the elongate member.

16. The snow thrower of claim 14, wherein the actuator guide member comprises a portion of the handle.

17. The snow thrower of claim 14, wherein the actuator guide member is substantially horizontal.

18. A snow thrower comprising:

a frame;

a handle coupled to the frame;

an actuator linearly movable between a plurality of positions; and a chute coupled to the frame and rotatable about a chute axis;

wherein the chute is coupled to the actuator by a coupling assembly including a rotatable flexible cable defining a cable axis, and wherein linearly moving the actuator between the plurality of positions causes the cable to rotate about the cable axis thereby causing the chute to rotate about the chute axis.

* * * * *